US005269577A

United States Patent [19]

Rogers et al.

[11] Patent Number: 5,269,577

[45] Date of Patent: Dec. 14, 1993

[54] CARPENTRY STUD ALIGNMENT TOOL

[76] Inventors: Bruce W. Rogers, P.O. Box 46, Umpqua, Oreg. 97486; Ivan S. Rogers, 487 NE. Russell, Roseburg, Oreg. 97470

[21] Appl. No.: 962,927

[22] Filed: Oct. 19, 1992

[51] Int. Cl.[5] ..... B66C 1/42

[52] U.S. Cl. ..... 294/16; 294/104

[58] Field of Search ..... 294/11, 16, 17, 104; 33/526, 613

[56] References Cited

U.S. PATENT DOCUMENTS

| | | | |
|---|---|---|---|
| 327,049 | 9/1885 | Worthington | 294/104 X |
| 429,328 | 6/1890 | Webb | 294/104 X |
| 902,570 | 11/1908 | Ellis | 294/104 X |
| 1,484,100 | 2/1924 | Wertz | 294/11 |
| 1,745,292 | 1/1930 | Buser | 294/104 X |
| 2,784,024 | 3/1957 | Edgerton | 294/104 X |
| 3,218,099 | 10/1965 | Stamborski | 294/104 X |
| 3,253,850 | 5/1966 | Trusty | 294/16 |
| 3,352,589 | 11/1967 | Kilboy et al. | 294/16 |

*Primary Examiner*—David M. Mitchell
*Assistant Examiner*—Dean J. Kramer
*Attorney, Agent, or Firm*—Leon Gilden

[57] ABSTRACT

A tool structure to effect a twisting alignment of carpentry studs for use is arranged to include cooperative first and second legs, with the first leg pivotally mounting a third leg that in turn is secured to the second leg, with a fourth leg secured to the third leg. A fifth leg pivotally mounted above the third leg is arranged for abutment with the fourth leg to effect projection of the second leg relative to the first leg. In this manner, securement of the associated carpentry stud is permitted accommodating its subsequent twisting for alignment and use.

3 Claims, 4 Drawing Sheets

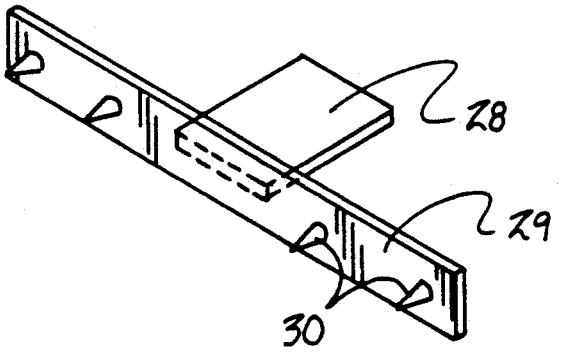
FIG 8B
FIG 9
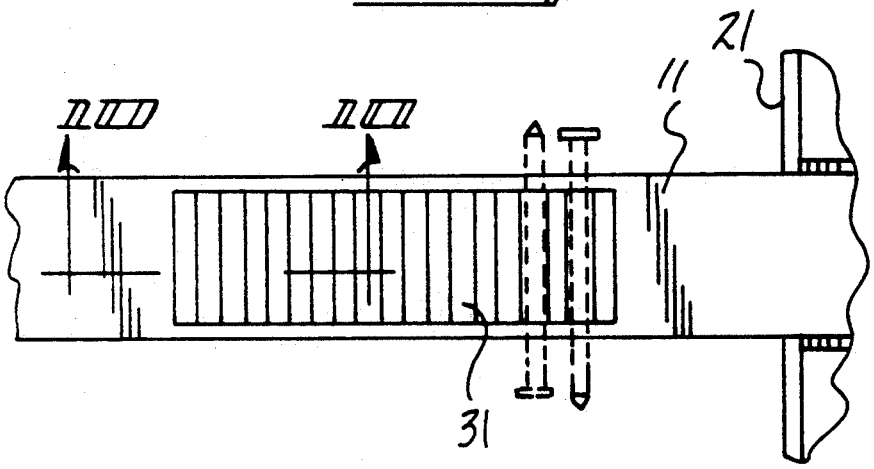
FIG 10
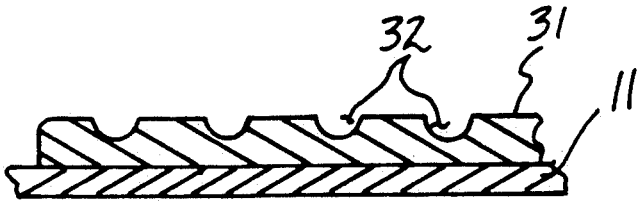

CARPENTRY STUD ALIGNMENT TOOL

BACKGROUND OF THE INVENTION

1. Field of the Invention

The field of invention relates to carpentry tool structure, and more particularly pertains to a new and improved carpentry stud alignment tool wherein the same is arranged for the securement and subsequent twisting of carpentry studs for their use in a building scenario.

2. Description of the Prior Art

Carpentry tools of various types are utilized in the prior art and such is exemplified in the U.S. Pat. Nos. 4,930,225; 4,955,142; 4,850,114; and 3,735,497.

The prior art has heretofore, however, failed to provide for a tool structure of the type as indicated by the instant invention addressing both the problems of ease of use as well as effectiveness in construction to permit the securement and twisting of carpentry studs in a manually manipulated manner and in this respect, the present invention substantially fulfills this need.

SUMMARY OF THE INVENTION

In view of the foregoing disadvantages inherent in the known types of carpentry tool structure now present in the prior art, the present invention provides a carpentry stud alignment tool wherein the same is arranged for the grasping and subsequent twisting of a carpentry stud for its alignment. As such, the general purpose of the present invention, which will be described subsequently in greater detail, is to provide a new and improved carpentry stud alignment tool which has all the advantages of the prior art carpentry tool structure and none of the disadvantages.

To attain this, the present invention provides a tool structure to effect a twisting alignment of carpentry studs for use, arranged to include cooperative first and second legs, with the first leg pivotally mounting a third leg that in turn is secured to the second leg, with a fourth leg secured to the third leg. A fifth leg pivotally mounted above the third leg is arranged for abutment with the fourth leg to effect projection of the second leg relative to the first leg. In this manner, securement of the associated carpentry stud is permitted accommodating its subsequent twisting for alignment and use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved carpentry stud alignment tool which has all the advantages of the prior art carpentry tool structure and none of the disadvantages.

It is another object of the present invention to provide a new and improved carpentry stud alignment tool which may be easily and efficiently manufactured and marketed.

It is a further object of the present invention to provide a new and improved carpentry stud alignment tool which is of a durable and reliable construction.

An even further object of the present invention is to provide a new and improved carpentry stud alignment tool which is susceptible of a low cost of manufacture with regard to both materials and labor, and which accordingly is then susceptible of low prices of sale to the consuming public, thereby making such carpentry stud alignment tools economically available to the buying public.

Still yet another object of the present invention is to provide a new and improved carpentry stud alignment tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an isometric illustration of a modified engaging flange structure.

FIG. 9 is an orthographic view of section 9 as set forth in FIG. 4.

FIG. 10 is an orthographic view, taken along the lines 10—10 of FIG. 9 in the direction indicated by the arrows.

DESCRIPTION OF THE PREFERRED EMBODIMENT

Figure 1:
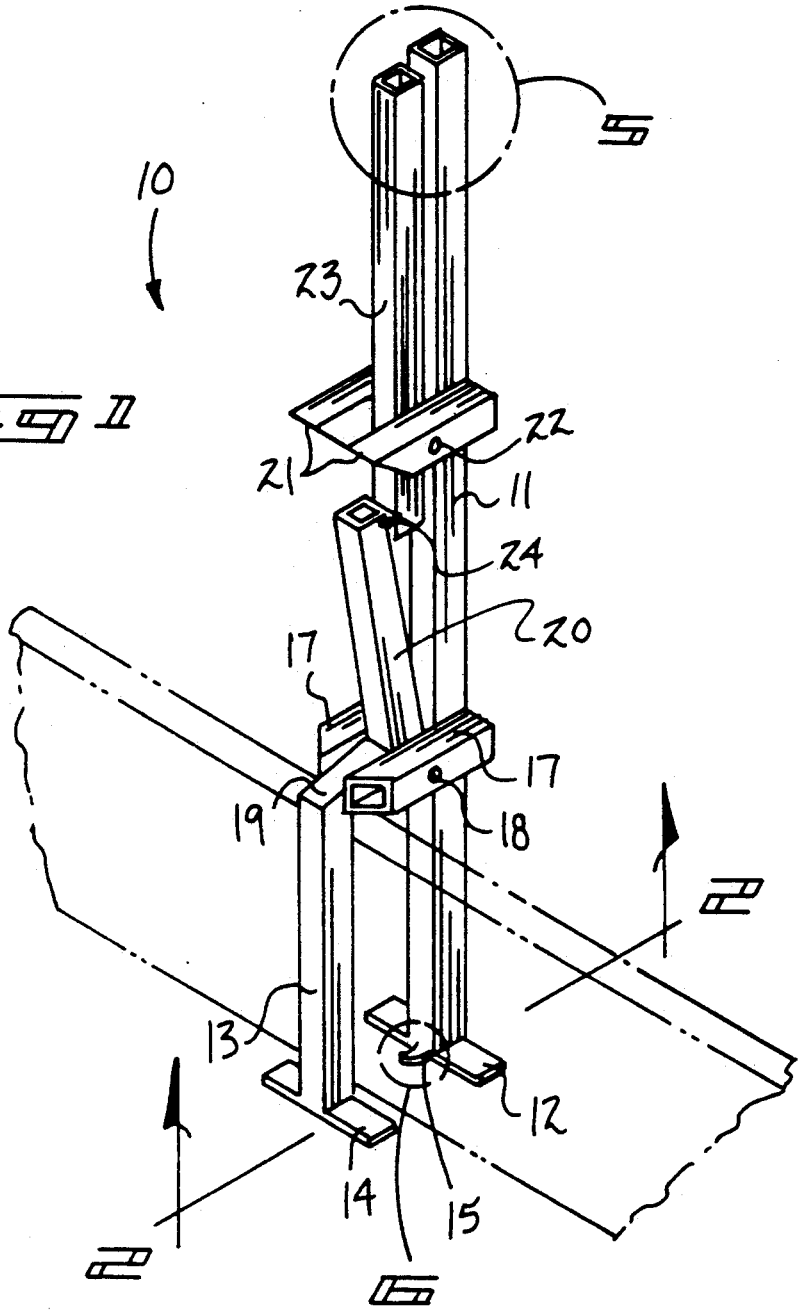
FIG. 1 is an isometric illustration of the invention.
Figure 2:
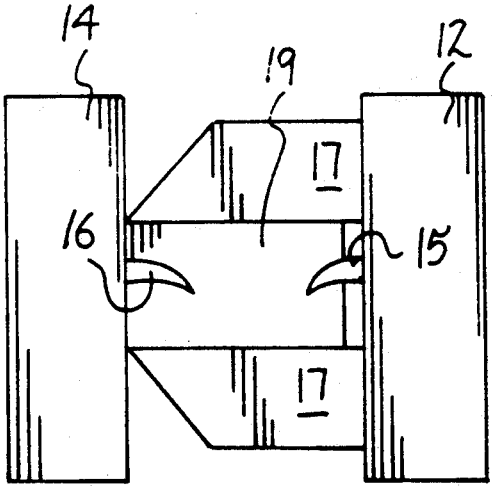
FIG. 2 is an orthographic view, taken along the lines 2—2 of FIG. 1 in the direction indicated by the arrows.
Figure 3:
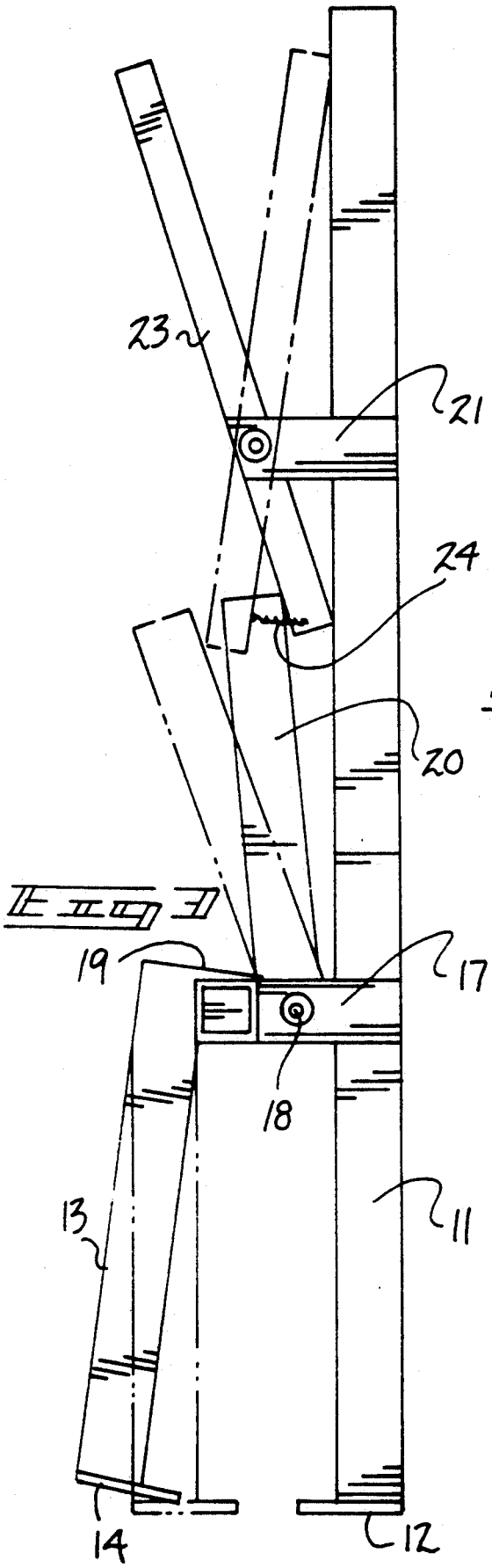
FIG. 3 is an orthographic side view of the invention.
Figure 4:
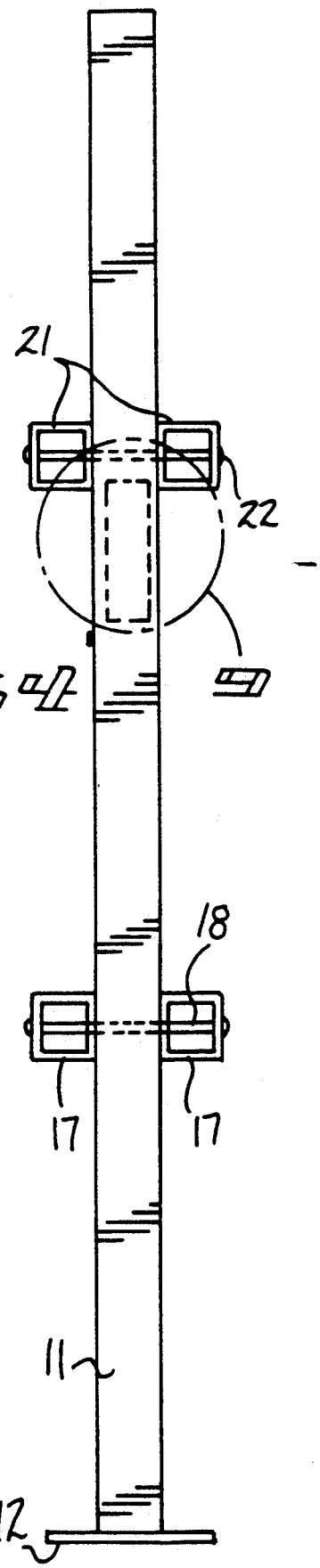
FIG. 4 is an orthographic rear view of the invention.

With reference now to the drawings, and in particular to FIGS. 1 to 10 thereof, a new and improved carpentry stud alignment tool embodying the principles and concepts of the present invention and generally designated by the reference numeral 10 will be described.

More specifically, the carpentry stud alignment tool 10 of the instant invention essentially comprises an elongate first leg 11 having a first leg support plate 12 orthogonally mounted to a lower distal end of the first leg 11. A second leg 13 includes a second leg support plate 14 orthogonally mounted to a lower distal end of the second leg 13, with the second leg 13 oriented in a confronting relationship relative to the first leg 11 to secure a building stud therebetween, in a manner as indicated in FIG. 1. A first piercing projection 15 is mounted to the first leg support plate 12 coplanar therewith in confronting relationship relative to a second leg support plate second piercing projection 16 that is arranged in confronting relationship relative to the first projection 15, with the second projection coplanar with the second leg support plate 14.

A third leg 19 is mounted to an uppermost end of the second leg 13, with a plurality of first support members 17 fixedly mounted to the first leg 11 above the lowermost end thereof, with the first support members 17 defining a first support pair mounted to opposed sides of the first leg 11 defining a first gap therebetween to receive the third leg 19, with a first axle 18 directed through the first support member 17 and the third leg 19 positioned between the first support member 17 pivotally mounting the third leg 19 and the second leg 13. A fourth leg 20 fixedly mounted to the third leg 19 extends along the first leg 11 upwardly of the first support pair 17. Second support members 21 are provided defining a second support pair oriented above the first support pair defining a second gap therebetween and pivotally mounting a fifth leg 23. A spring member 24 is mounted to a lower distal end of the fifth leg 23 and to the fourth leg 20 adjacent the fourth leg's upper distal end. The spring member is arranged to maintain adjacency relative to the fifth leg 23 at its lower distal end and the fourth leg 20 at its upper distal end. Upon directing the upper distal end of the fifth leg 23 towards the upper distal end of the first leg 11, the second leg 13 is directed towards the first leg 11, and more specifically, the first projection 15 is directed towards the second projection 16.

Figure 5:
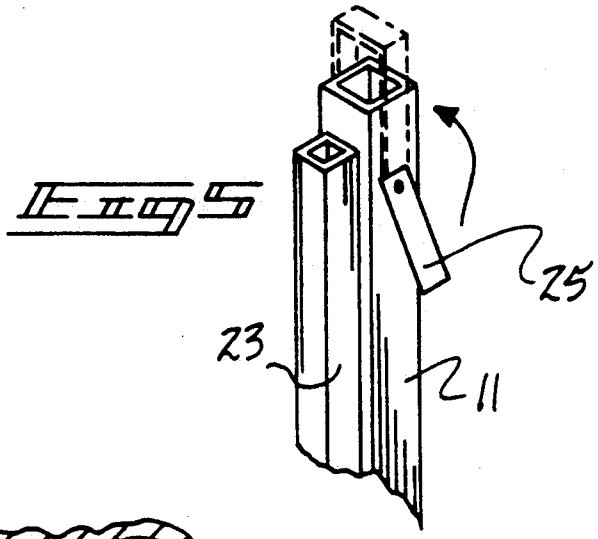
FIG. 5 is an isometric modified illustration of section 5 as set forth in FIG. 1.

The FIG. 5 indicates the use of a locking loop 25 pivotally mounted adjacent the upper distal end of the first leg 11, and arranged to pivot to receive the fifth leg 23 to secure the fifth leg in adjacency to the first leg 11 and thereby maintain projection of the first piercing projection towards the second piercing projection.

Figure 6:
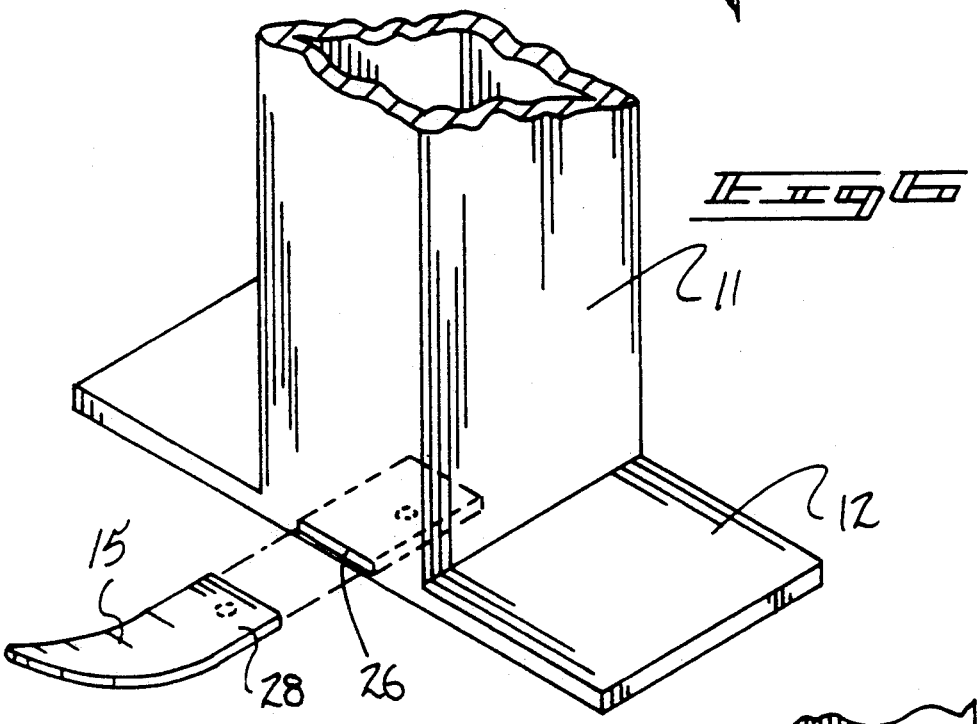
FIG. 6 is an enlarged modified isometric illustration of section 6 as set forth in FIG. 1.
Figure 7:
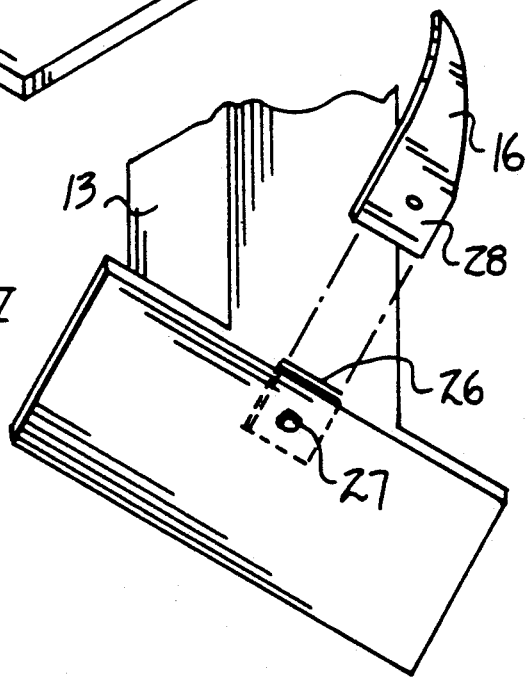
FIG. 7 is an isometric bottom view of the second leg utilizing the receiving slot structure, as indicated in FIG. 6, for the first leg.

The FIGS. 6 and 7 indicate the use of the first and second piercing projections 15 and 16, each received within a respective slot 26 arranged within the lower distal ends of the first and second legs 11 and 13 and coplanar with the respective first leg support plate 12 and the second leg support plate 14. Each of the piercing projections includes a locking tang 28 received within the respective slot 26, with a lock screw 27 arranged for reception within the associated slot 26 to insure a respective locking tang 28 therewithin, as indicated.

The FIG. 8 indicates the use of the locking tang 28 having an engaging flange 29 orthogonally mounted thereto in lieu of the associated projection 15 or 16, with each of the engaging flanges 29 including a series of spaced flange projections 30 orthogonally oriented relative to the engaging flange 29 for projection within an associated carpentry stud, as indicated in FIG. 1.

The FIG. 9 indicates the use of a ferromagnetic plate 31 mounted to the first leg 11 between the first and second support members 17 and 21, with the magnetic plate 31 including a series of parallel plate grooves 32, with each groove arranged for securing a nail therewithin in a removable manner for subsequent use in mounting the carpentry stud structure of FIG. 1.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A carpentry stud alignment tool, comprising, a first leg, the first leg having a first leg lower distal end and a first leg upper distal end, and a plurality of first support members mounted to the first leg spaced from the first leg lower distal end defining a first gap between the first support members, and a plurality of second support members fixedly mounted to the first leg between the first support members and the first leg upper distal end, with the second support members defining a second gap therebetween, and the first gap positioned in alignment with and above the first gap, and a second leg, the second leg having a second leg lower distal end positioned in adjacency relative to the first leg lower distal end, and the second leg having a second leg upper distal end, the second leg upper distal end including a third leg secured thereto with the second leg upper distal end, and the third leg having a fourth leg fixedly secured to the third leg, with the third leg positioned within the first gap, and a first axle directed through the third leg and through the first support members, and a fifth leg pivotally mounted within the second gap arranged for abutment with the fourth leg to project the second leg towards the first leg, and the fifth leg includes a fifth leg lower distal end, and the fourth leg includes a fourth leg upper distal end, and a spring member mounted between the fourth leg upper distal end and the fifth leg lower distal end to bias the fourth leg to the fifth leg.

2. A tool as set forth in claim 1 wherein the first leg lower distal end includes a first support plate, and the second leg lower distal end includes a second support plate, with the first support plate orthogonally oriented relative to the first leg, and the second support plate orthogonally oriented relative to the second leg, and a first piercing projection mounted within the first support plate, and a second piercing member mounted within the second support plate, with the first piercing arranged for confronting relationship relative to the second piercing projection.

3. A tool as set forth in claim 2 wherein the first support plate and the second support plate each include a slot, and each piercing projection includes a support tang, with each support tang arranged for reception within a respective slot.

* * * * *